US011614266B1

(12) United States Patent
Sutton

(10) Patent No.: US 11,614,266 B1
(45) Date of Patent: Mar. 28, 2023

(54) PORTABLE COOLER WITH FOLDOUT BAR

(71) Applicant: Reggie Sutton, Coquitlam (CA)

(72) Inventor: Reggie Sutton, Coquitlam (CA)

( * ) Notice: Subject to any disclaimer, the term of this patent is extended or adjusted under 35 U.S.C. 154(b) by 147 days.

(21) Appl. No.: 17/216,853

(22) Filed: Mar. 30, 2021

(51) Int. Cl.

| | |
|---|---|
| ***F25D 3/06*** | (2006.01) |
| ***F25D 7/00*** | (2006.01) |
| ***B65D 81/38*** | (2006.01) |
| ***A47B 13/08*** | (2006.01) |
| ***A47B 43/00*** | (2006.01) |
| ***A47B 31/00*** | (2006.01) |
| ***A47B 31/02*** | (2006.01) |

(52) U.S. Cl.
CPC ..... *F25D 3/06* (2013.01); *A47B 13/081* (2013.01); *A47B 43/00* (2013.01); *B65D 81/3813* (2013.01); *F25D 7/00* (2013.01); *A47B 2031/002* (2013.01); *A47B 2031/003* (2013.01); *A47B 2031/008* (2013.01); *A47B 2031/026* (2013.01)

(58) Field of Classification Search
CPC . F25D 3/06; F25D 3/08; A47B 13/081; A47B 31/04; A47B 43/00; A47B 2031/002; A47B 2031/003; A47B 2031/008; A47B 2031/026
See application file for complete search history.

(56) References Cited

U.S. PATENT DOCUMENTS

| | | | | |
|---|---|---|---|---|
| 1,913,387 A * | 6/1933 | Hayward | A47B 69/00 312/314 |
| 2,083,852 A | 6/1937 | Effie | |
| 2,771,334 A * | 11/1956 | Wahlbom | A47B 69/00 312/258 |
| 2,808,305 A * | 10/1957 | Jackson | A47B 43/00 312/258 |
| 3,588,209 A * | 6/1971 | Nathan | A47B 43/00 312/258 |
| 3,927,924 A * | 12/1975 | Kelley | A47B 87/002 312/263 |
| 5,251,790 A * | 10/1993 | Cohn | B67D 1/06 62/390 |
| D370,159 S | 5/1996 | Fenton | |
| 6,010,043 A | 1/2000 | Williamson | |
| 6,895,778 B1 | 5/2005 | Ackerman | |
| 7,201,458 B2 * | 4/2007 | DeMars | E04H 1/1222 312/258 |
| 7,896,451 B2 * | 3/2011 | Walsh | A47F 3/043 312/139.2 |

(Continued)

FOREIGN PATENT DOCUMENTS

| | | | |
|---|---|---|---|
| EP | 1795087 A1 * | 6/2007 | A47B 19/08 |
| WO | 2011022729 | 2/2011 | |

*Primary Examiner* — Daniel J Rohrhoff
(74) *Attorney, Agent, or Firm* — Kyle A. Fletcher, Esq.

(57) ABSTRACT

The portable cooler with fold out bar comprises a bar body, a cooler, an ice well, a multi-use bucket, a speed rail, and one or more bar accessories. The bar body may be transported to a venue using a pair of all terrain wheels located on the bottom of the bar body. The bar body may be opened to provide access to the cooler, the ice well, the multi-use bucket, the speed rail, and the one or more bar accessories. The bar body may be operable as the bottom support of a bar. A left counter top and a right counter top may be unfolded to align with a main counter top to form a counter top at the top of the bar body.

18 Claims, 8 Drawing Sheets

(56) References Cited

U.S. PATENT DOCUMENTS

| | | | | |
|---|---|---|---|---|
| 8,534,779 | B2 * | 9/2013 | Schaaf | A47B 46/005 312/272.5 |
| 9,146,051 | B2 | 9/2015 | Kamin | |
| 10,463,174 | B2 * | 11/2019 | Hesselmann | A47F 5/10 |
| 10,653,238 | B1 * | 5/2020 | Bucci | A47B 3/12 |
| 11,172,758 | B1 * | 11/2021 | Stewart | A47B 3/06 |
| 2001/0010419 | A1 * | 8/2001 | Kasuya | A47B 31/06 280/33.997 |
| 2011/0204756 | A1 * | 8/2011 | DeMars | A47F 9/00 312/258 |
| 2012/0273505 | A1 | 11/2012 | Bose | |
| 2022/0228794 | A1 * | 7/2022 | Whyman | A47B 31/02 |

* cited by examiner

PORTABLE COOLER WITH FOLDOUT BAR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of portable food serving equipment, more specifically, a portable cooler with fold out bar.

SUMMARY OF INVENTION

The portable cooler with fold out bar comprises a bar body, a cooler, an ice well, a multi-use bucket, a speed rail, and one or more bar accessories. The bar body may be transported to a venue using a pair of all terrain wheels located on the bottom of the bar body. The bar body may be opened to provide access to the cooler, the ice well, the multi-use bucket, the speed rail, and the one or more bar accessories. The bar body may be operable as the bottom support of a bar. A left counter top and a right counter top may be unfolded to align with a main counter top to form a counter top at the top of the bar body.

An object of the invention is to provide a portable bar which opens to provide access to a cooler, an ice well, a multi-use bucket, a speed rail, and one or more bar accessories.

Another object of the invention is to provide a main counter top on the portable bar than may be extended by unfolding a left counter top and a right counter top.

A further object of the invention is to provide one or more storage containers, one or more pockets, one or more bottle holders, one or more utensil holders, one or more tower holders, or combinations thereof.

Yet another object of the invention is to provide a pair of wheels and a pair of legs to move and support the portable bar.

These together with additional objects, features and advantages of the portable cooler with fold out bar will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable cooler with fold out bar in detail, it is to be understood that the portable cooler with fold out bar is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable cooler with fold out bar.

It is therefore important that the claims be regarded as including such equivalent construction insofar as they do not depart from the spirit and scope of the portable cooler with fold out bar. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
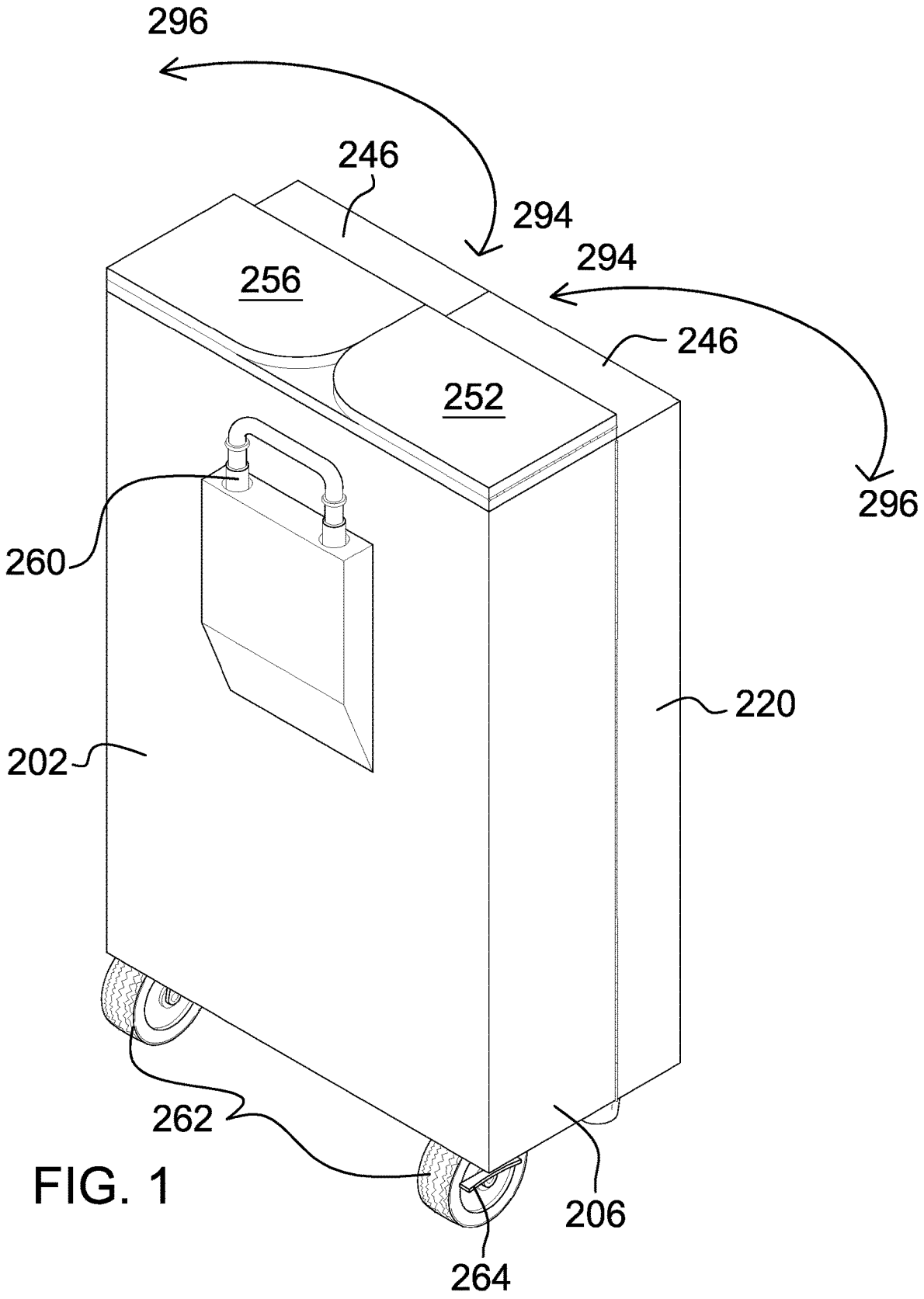
FIG. 1 is a rear isometric view of an embodiment of the disclosure illustrating the doors in the closed position.
Figure 2:
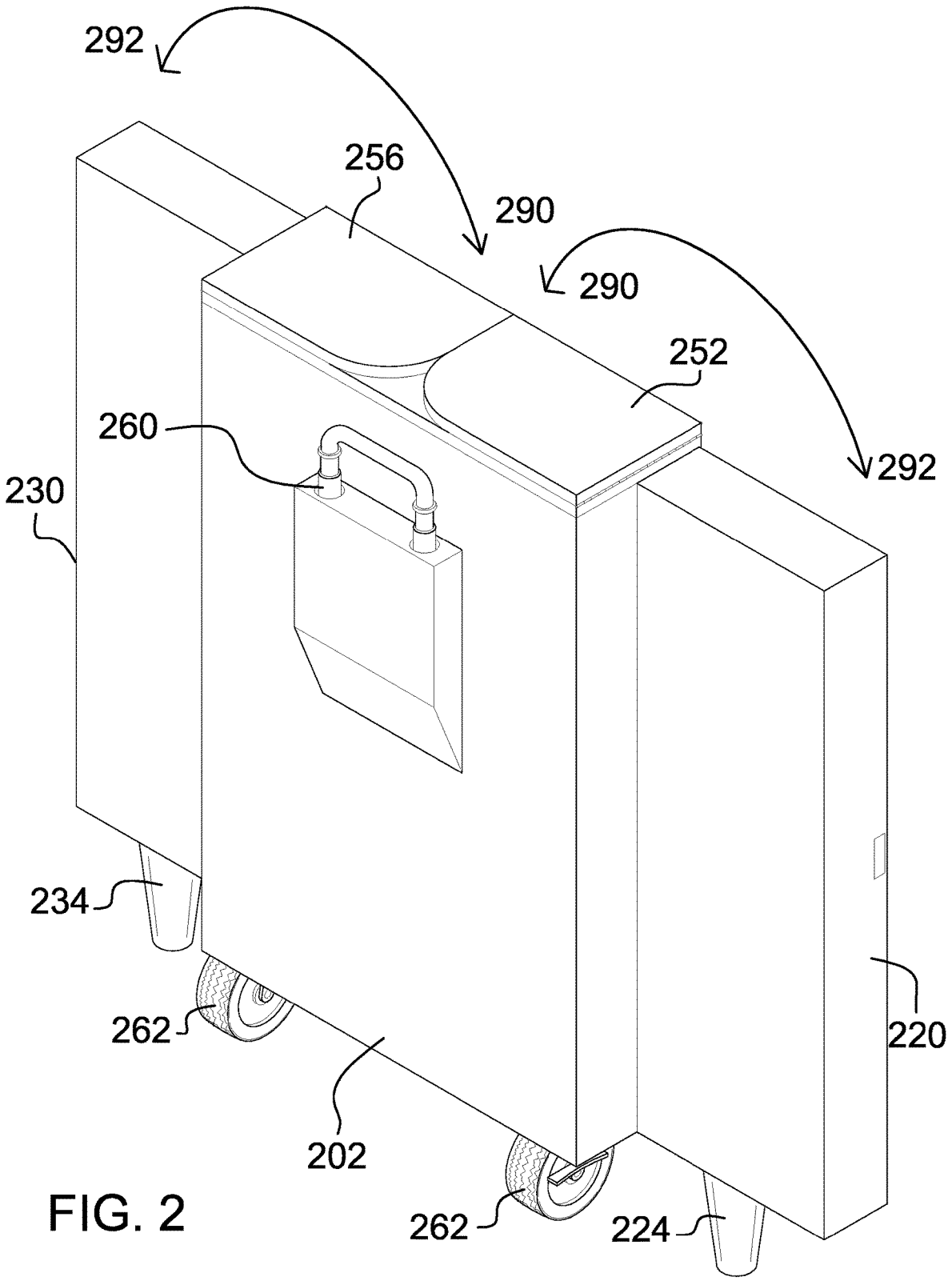
FIG. 2 is a rear isometric view of an embodiment of the disclosure illustrating the doors in the open position and the left and right counter tops in the stored position.
Figure 3:
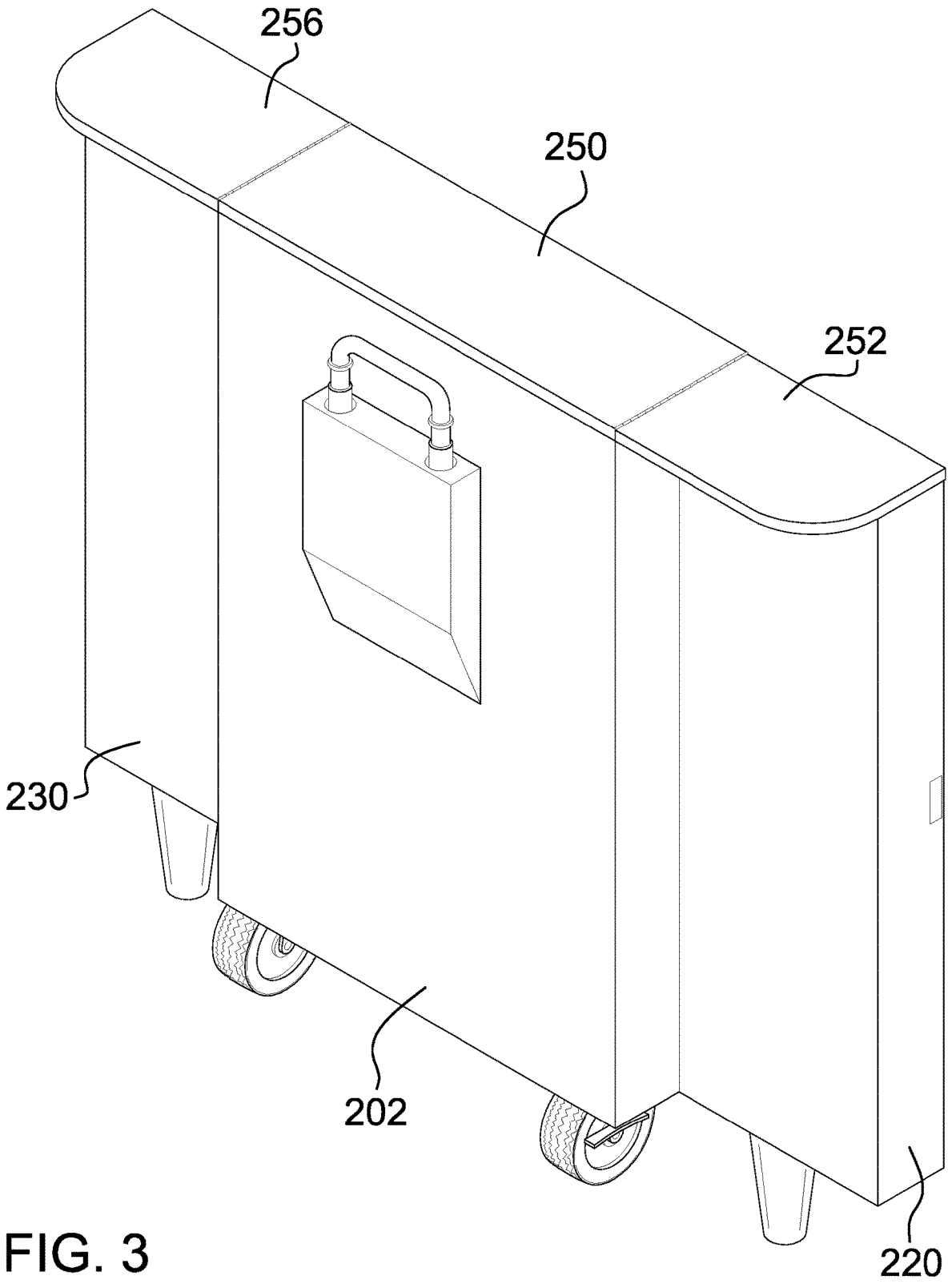
FIG. 3 is a rear isometric view of an embodiment of the disclosure illustrating the doors in the open position and the left and right counter tops in the deployed position.
Figure 4:
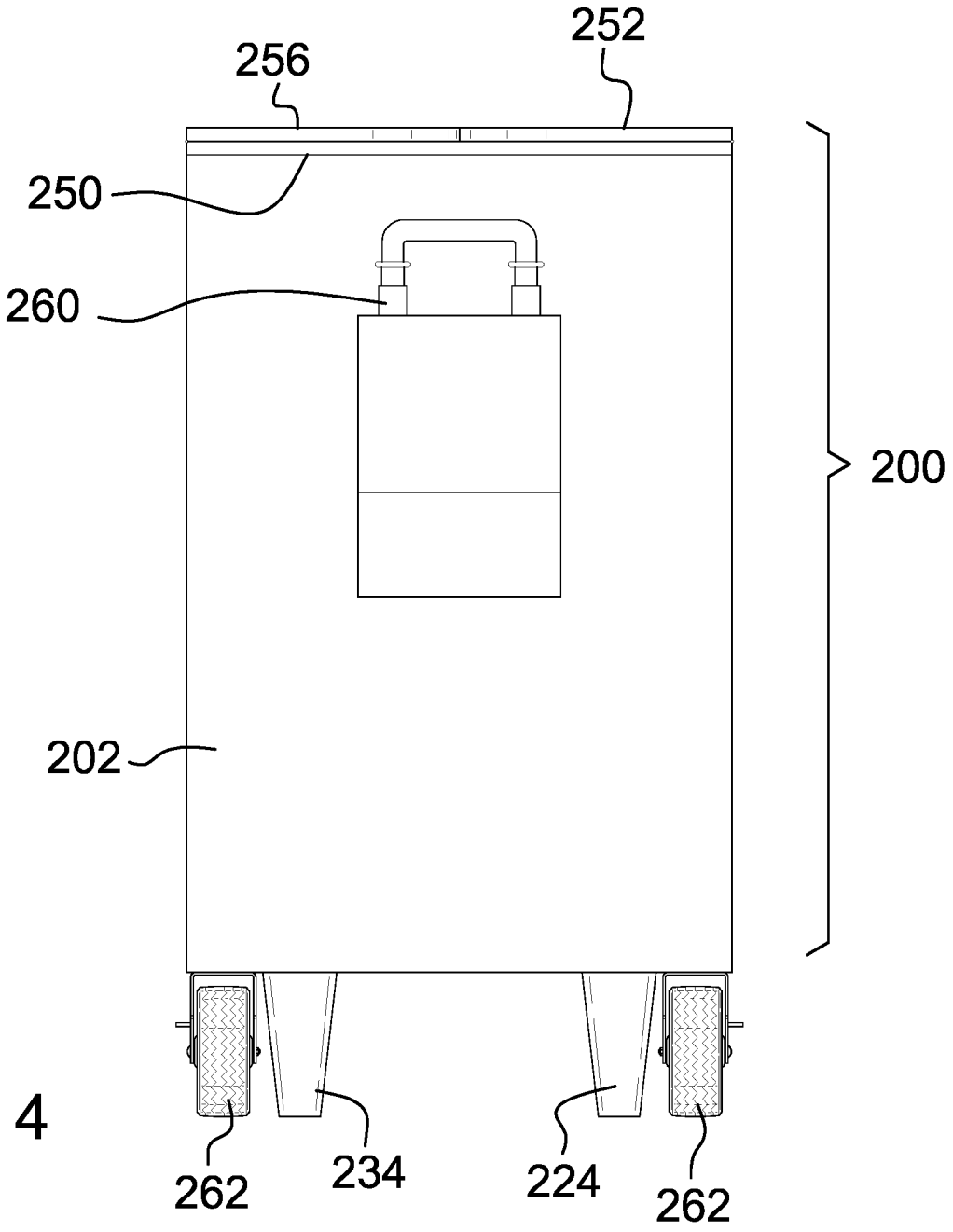
FIG. 4 is a rear view of an embodiment of the disclosure.
Figure 5:
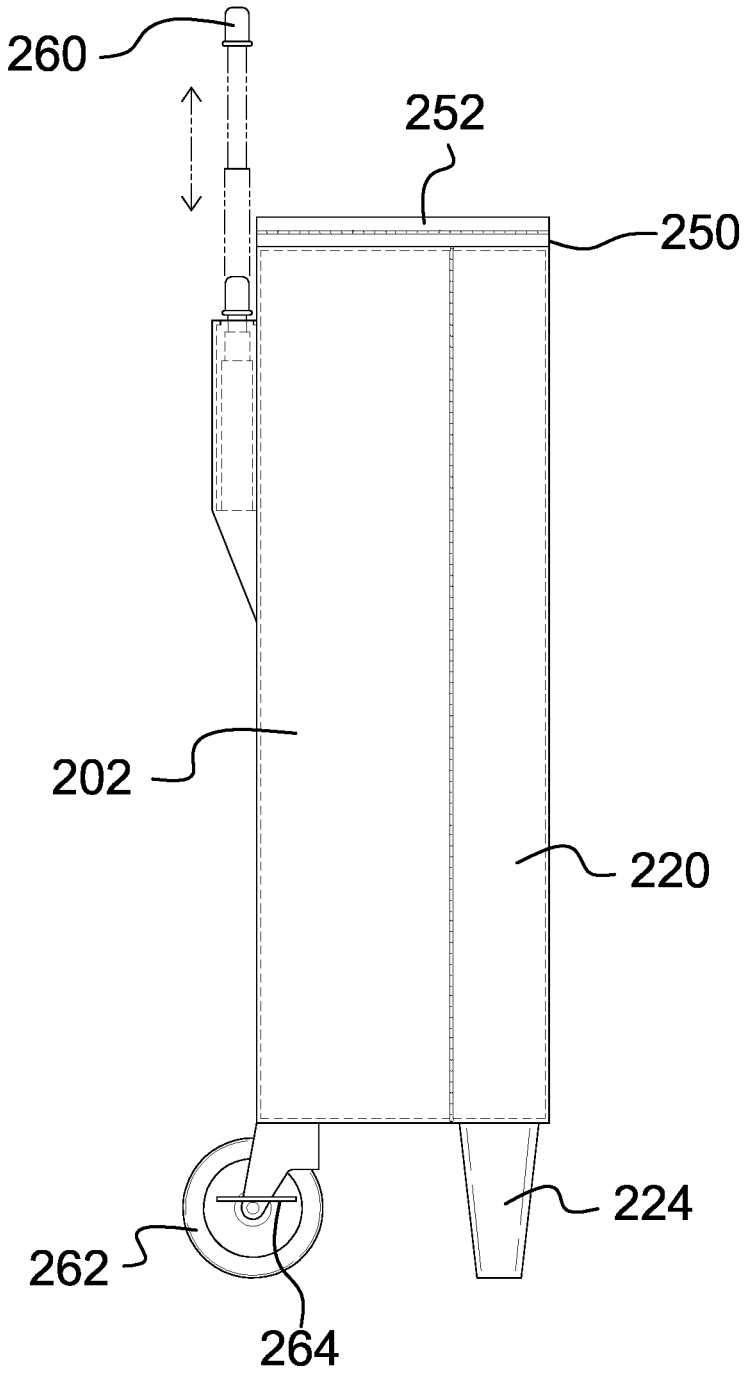
FIG. 5 is a left side view of an embodiment of the disclosure.
Figure 6:
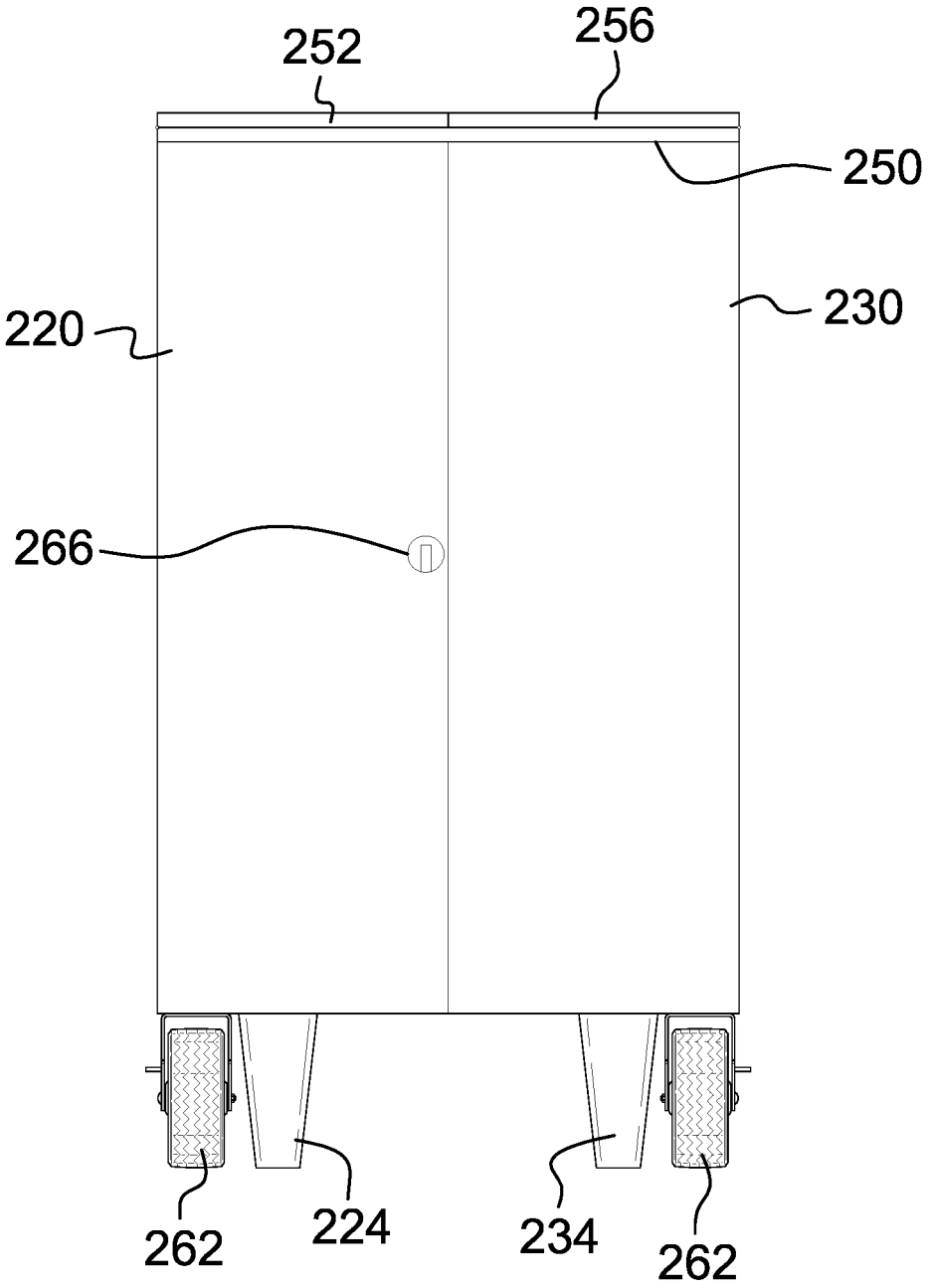
FIG. 6 is a front view of an embodiment of the disclosure.
Figure 7:
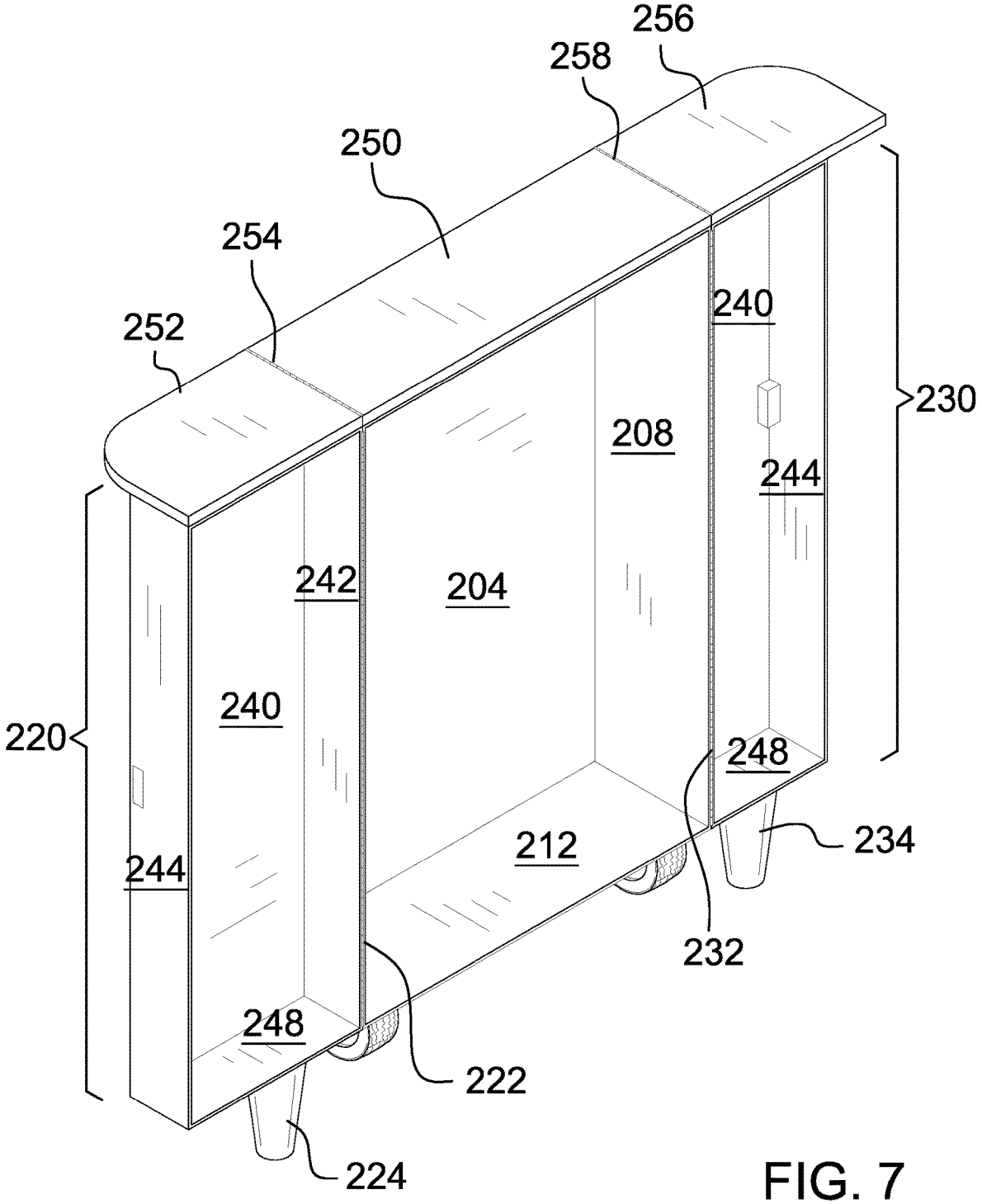
FIG. 7 is a detail view of an embodiment of the disclosure illustrating the bar body open.
Figure 8:
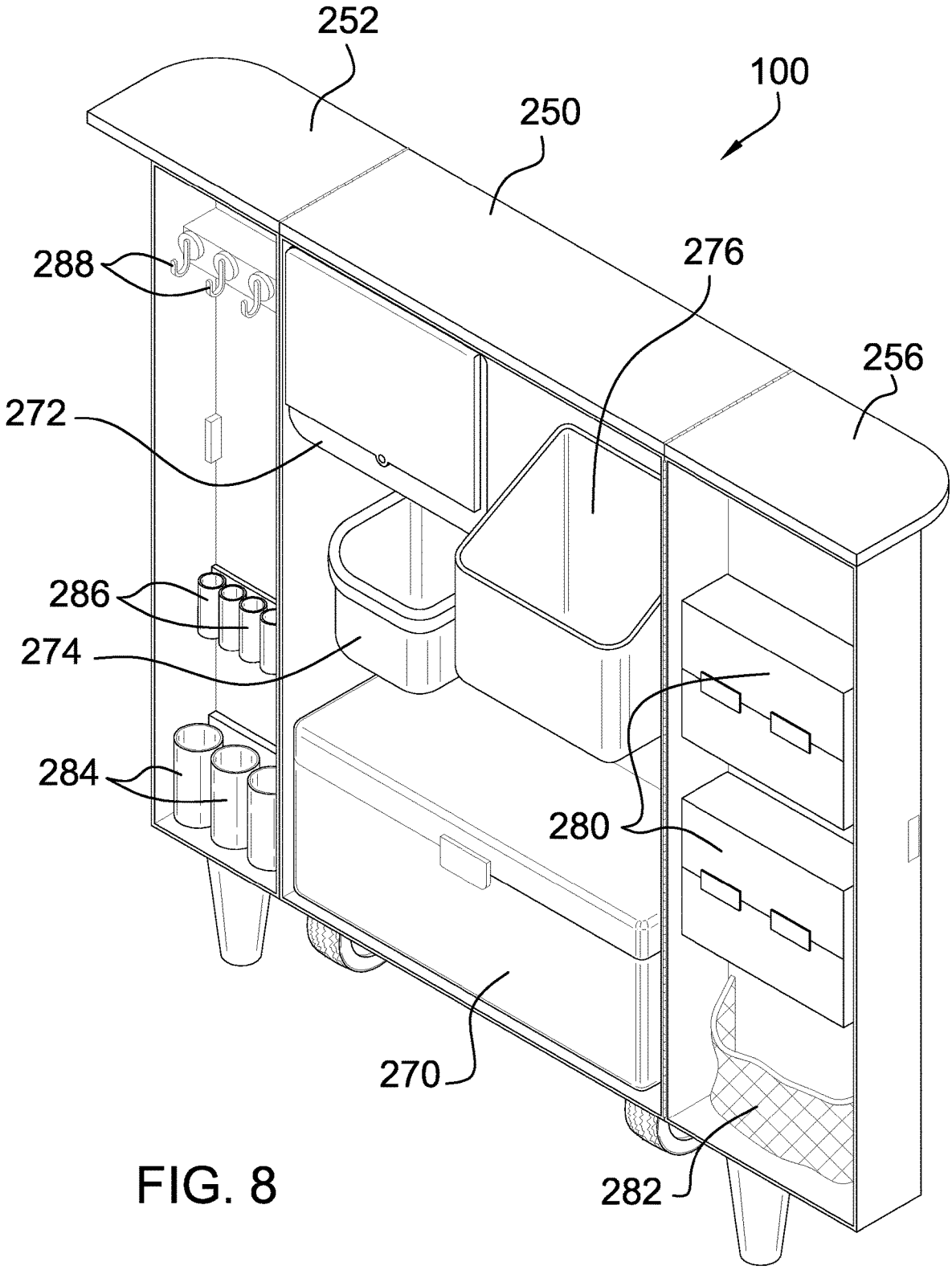
FIG. 8 is an in-use view of an embodiment of the disclosure illustrating the cooler, ice well, multi-use bucket, speed rail, storage containers, pockets, bottle holders, utensil holders, and towel holders in place within the bar body.

Detailed reference will now be made to a first potential embodiment of the disclosure, which is illustrated in FIGS. 1 through 8.

The portable cooler with fold out bar 100 (hereinafter invention) comprises a bar body 200, a cooler 270, an ice well 272, a multi-use bucket 274, a speed rail 276, and one or more bar accessories. The bar body 200 may be transported to a venue using a pair of all terrain wheels 262 located on the bottom of the bar body 200. The bar body 200 may then be opened to provide access to the cooler 270, the ice well 272, the multi-use bucket 274, the speed rail 276, and the one or more bar accessories. The bar body 200 may be operable as the bottom support of a bar. A left counter top 252 and a right counter top 256 may be unfolded to align with a main counter top 250 to form a counter top at the top of the bar body 200.

The bar body 200 may comprise a back shell 202, a left door shell 220, and a right door shell 230. The bar body 200 may be a hollow rectangular container that houses the cooler 270, the ice well 272, the multi-use bucket 274, the speed rail 276, and the one or more bar accessories.

The back shell 202 may be the rear portion of the bar body 200. The back shell 202 may comprise a body rear wall 204, a body left side wall 206, a body right side wall 208, and a body bottom wall 212. The back shell 202 may be open at the front along a vertically-oriented plane.

The pair of all terrain wheels 262 may be coupled to the bottom of the bar body 200. The pair of all terrain wheels 262 may be operable to move the bar body 200 over terrain to reach the venue. When the bar body 200 is stationary and opened, the pair of all terrain wheels 262 may be operable to support the bar body 200 in conjunction with a left leg 224 and a right leg 234. In some embodiments, the pair of all terrain wheels 262 may comprise wheel locks 264 to prevent the bar body 200 from moving when the wheel locks 264 are placed into a locked position.

The left door shell 220 and the right door shell 230 may be the front portions of the bar body 200. The left door shell 220 may be hingedly coupled to the back shell 202 via a left door hinge 222. The right door shell 230 may be hingedly coupled to the back shell 202 via a right door hinge 232. The left door shell 220 and the right door shell 230 may pivot between a closed position 294 and an open position 296. The left door shell 220 and the right door shell 230 may each comprise a door front wall 240, a first door side wall 242, a second door side wall 244, a door top wall 246, and a door bottom wall 248. The first door side walls 242 may hingedly couple to the back shell 202 and the second door side walls 244 may meet when the bar body 200 is closed.

When in the closed position 294, the left door shell 220 and the right door shell 230 may pivot to a position where the left door shell 220 and the right door shell 230 may be adjacent to the back shell 202 and may be adjacent to teach other at the front of the bar body 200. When in the open position 296, the left door shell 220 and the right door shell 230 may each pivot to a position that is oriented 180 degrees from the closed position. When in the closed position 294, the second door side wall 244 of the left door shell 220 and the second door side wall 244 of the right door shell 230 may be latched to each other using a door lock 266. The left leg 224 may be coupled to the bottom of the door bottom wall 248 on the left door shell 220 and the right leg 234 may be coupled to the bottom of the door bottom wall 248 on the right door shell 230. The left leg 224 and the right leg 234 may stabilize the bar body 200 when the bar body 200 is not being transported via the pair of all terrain wheels 262.

The bar body 200 may comprise a handle 260 that may be operable to pull the bar body 200 over terrain to the venue. The handle 260 may be stored within the back shell 202 when not in use and may be extended from within the back shell 202 for use.

The main counter top 250 may be operable as a work surface for preparing and serving food and beverages. The main counter top 250 may be coupled to the top of the back shell 202. The left counter top 252 and the right counter top 256 may be hingedly coupled to the left and right ends of the main counter top 250, respectively. The left counter top 252 may be coupled to the main counter top 250 via a left counter hinge 254. The right counter top 256 may be coupled to the main counter top 250 via a right counter hinge 258. The left counter top 252 and the right counter top 256 may pivot between a stored position 290 and a deployed position 292. When in the stored position 290, the left counter top 252 and the right counter top 256 may be folded back onto the main counter top 250. When in the deployed position 292, the left counter top 252 and the right counter top 256 may be unfolded to be coplanar with the main counter top 250 and may extend the width of the main counter top 250. The left counter top 252 may rest upon the left door shell 220 when in the deployed position 292 and the right counter top 256 may rest upon the right door shell 230 when in the deployed position 292.

The cooler 270 may be an insulated container that may be coupled to the inside of the back shell 202. The cooler 270 may comprise an insulated lid that may be operable to thermally seal the cooler 270. The cooler 270 may be operable to store the food and the beverages that must be chilled. The cooler 270 may comprise a cooler drain to drain water from the cooler 270.

The ice well 272 may be an insulated container for storing ice. The ice well 272 may be coupled to the inside of the back shell 202. The ice may be accessible via an ice door on the front of the ice well 272. The ice well 272 may comprise a well drain to drain water from the ice well 272.

The multi-use bucket 274 may be an open-top container that is coupled to the inside of the back shell 202. The multi-use bucket 274 may be operable to hold items that are placed within the multi-use bucket 274. As a non-limiting example, the multi-use bucket 274 may be operable pouring unfinished beverages into.

The speed rail 276 may be an open top tray for holding liquors, wines, and mixers for immediate access.

The one or more bar accessories may comprise one or more storage containers 280, one or more pockets 282, one or more bottle holders 284, one or more utensil holders 286, one or more towel holders 288, or combinations thereof. The one or more bar accessories may hold the food, the beverages, and/or serving utensils that may be needed at the venue.

The one or more storage containers 280 may be one or more containers coupled to the inside of the right door shell 230 or the left door shell 220. The one or more storage containers 280 may close to contain the items within and may be opened to add or remove items. As non-limiting examples, the one or more storage containers 280 may hold bar snacks, napkins, or drink stirrers.

The one or more pockets 282 may be one or more pouches that are coupled to the inside of the right door shell 230 or the left door shell 220. In some embodiments, the one or more pockets 282 may be made of a see-through mesh material. As a non-limiting example, the one or more pockets 282 may hold plastic cocktail glasses.

The one or more bottle holders 284 may be cylindrical, open-topped receptacles that are closed on the bottom. The one or more bottle holders 284 may each be operable to hold a bottle. The one or more bottle holders 284 may be coupled to the inside of the left door shell 220 or the right door shell 230.

The one or more utensil holders 286 may be cylindrical, open-topped receptacles that are closed on the bottom. The one or more utensil holders 286 may each be operable to hold one or more eating utensils. The one or more utensil holders 286 may be coupled to the inside of the left door shell 220 or the right door shell 230.

The one or more towel holders 288 may be one or more hooks that may each be operable to hold a towel. The one or more towel holders 288 may be coupled to the inside of the left door shell 220 or the right door shell 230.

In use, the invention 100 may be transported to the venue by pulling the handle 260 to roll the bar body 200 on the pair of all terrain wheels 262. Upon arriving at the venue, the bar body 200 may be opened by pivoting the left door shell 220 and the right door shell 230 outwards. The left counter top 252 and the right counter top 256 may be unfolded to extend the main counter top 250. The food, the beverages, and supplies may be retrieved from the cooler 270, the one or more storage containers 280, the speed rail 276, the one or more pockets 282, the one or more bottle holders 284, and the one or more utensil holders 286. Items may be discarded into the multi-use bucket 274. Ice may be retrieved from the ice well 272. Towels may be obtained from the one or more towel holders 288. After use, the left door shell 220 and the right door shell 230 may be pivoted to close the bar body 200 and the invention 100 may be pulled away from the venue.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "accessory" may be a second object that adds to the convenience or attractiveness of a first object. In some instances, an accessory may extend the functionality of the first object by allowing the combination of the accessory plus the first object to perform a task that the first object could not perform alone.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, a "beverage" may be a liquid that is intended for consumption by a person.

As used herein, the words "couple", "couples", "coupled" or "coupling", may refer to connecting, either directly or indirectly, and does not necessarily imply a mechanical connection.

As used herein, "food" may refer to any substance that people or animals eat or drink, or that plants absorb.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object by which a tool, object, or door is held or manipulated with the hand.

As used in this disclosure, a "hinge" may be a device that permits the turning, rotating, or pivoting of a first object relative to a second object.

As used in this disclosure, a "lid" may be a movable or removable cover that is placed on a hollow structure to contain and/or protect the contents within the hollow structure.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used in this disclosure, a "shell" may be a structure that forms an outer covering intended to contain an object. Shells are often, but not necessarily always, rigid or semi-rigid structures that are intended to protect the object contained within it. Some shells may only partially cover the exterior surface of the object.

As used herein, "speed rail" may refer to a bar accessory that attaches under the bar and is used to store an assortment of frequently used and/or high-profit liquors, wines, and mixers.

As used in this disclosure, "vertical" may refer to a direction that is parallel to the local force of gravity. Unless specifically noted in this disclosure, the vertical direction is always perpendicular to horizontal.

As used in this disclosure, a "wheel" may be a circular object that revolves around an axle or an axis and is fixed below an object to enable it to move easily over the ground.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable cooler with fold out bar comprising:

a bar body, a cooler, an ice well, a multi-use bucket, a speed rail, and one or more bar accessories;

wherein the bar body is transported to a venue using a pair of all terrain wheels located on the bottom of the bar body;

wherein the bar body is opened to provide access to the cooler, the ice well, the multi-use bucket, the speed rail, and the one or more bar accessories;

wherein the bar body is operable as the bottom support of a bar;

wherein a left counter top and a right counter top are unfolded to align with a main counter top to form a counter top at the top of the bar body;

wherein the bar body comprises a back shell, a left door shell, and a right door shell;

wherein the bar body is a hollow rectangular container that houses the cooler, the ice well, the multi-use bucket, the speed rail, and the one or more bar accessories;

wherein the back shell is the rear portion of the bar body;

wherein the back shell comprises a body rear wall, a body left side wall, a body right side wall, and a body bottom wall;

wherein the back shell is open at the front along a vertically-oriented plane.

2. The portable cooler with fold out bar according to claim 1 wherein the pair of all terrain wheels are coupled to the bottom of the bar body;

wherein the pair of all terrain wheels are operable to move the bar body over terrain to reach the venue;

wherein when the bar body is stationary and opened, the pair of all terrain wheels are operable to support the bar body in conjunction with a left leg and a right leg.

3. The portable cooler with fold out bar according to claim 2 wherein the pair of all terrain wheels comprise wheel locks to prevent the bar body from moving when the wheel locks are placed into a locked position.

4. The portable cooler with fold out bar according to claim 2 wherein the left door shell and the right door shell are the front portions of the bar body;

wherein the left door shell is hingedly coupled to the back shell via a left door hinge;

wherein the right door shell is hingedly coupled to the back shell via a right door hinge;

wherein the left door shell and the right door shell pivot between a closed position and an open position;

wherein the left door shell and the right door shell each comprise a door front wall, a first door side wall, a second door side wall, a door top wall, and a door bottom wall;

wherein the first door side walls hingedly couple to the back shell and the second door side walls meet when the bar body is closed.

5. The portable cooler with fold out bar according to claim 4 wherein when in the closed position, the left door shell and the right door shell pivot to a position where the left door shell and the right door shell are adjacent to the back shell and are adjacent to teach other at the front of the bar body;

wherein when in the open position, the left door shell and the right door shell each pivot to a position that is oriented 180 degrees from the closed position.

6. The portable cooler with fold out bar according to claim 5 wherein when in the closed position, the second door side wall of the left door shell and the second door side wall of the right door shell are latched to each other using a door lock;

wherein the left leg is coupled to the bottom of the door bottom wall on the left door shell and the right leg is coupled to the bottom of the door bottom wall on the right door shell;

wherein the left leg and the right leg stabilize the bar body when the bar body is not being transported via the pair of all terrain wheels.

7. The portable cooler with fold out bar according to claim 6 wherein the bar body comprises a handle that is operable to pull the bar body over terrain to the venue;

wherein the handle is stored within the back shell when not in use and is extended from within the back shell for use.

8. The portable cooler with fold out bar according to claim 7 wherein the main counter top is operable as a work surface;

wherein the main counter top is coupled to the top of the back shell;

wherein the left counter top and the right counter top are hingedly coupled to the left and right ends of the main counter top, respectively;

wherein the left counter top is coupled to the main counter top via a left counter hinge;

wherein the right counter top is coupled to the main counter top via a right counter hinge;

wherein the left counter top and the right counter top pivot between a stored position and a deployed position;

wherein when in the stored position, the left counter top and the right counter top are folded back onto the main counter top;

wherein when in the deployed position, the left counter top and the right counter top are unfolded to be coplanar with the main counter top and extend the width of the main counter top;

wherein the left counter top rests upon the left door shell when in the deployed position and the right counter top rests upon the right door shell when in the deployed position.

9. The portable cooler with fold out bar according to claim 8 wherein the cooler is an insulated container that is coupled to the inside of the back shell;

wherein the cooler comprises an insulated lid that is operable to thermally seal the cooler;

wherein the cooler is operable to store food and beverages.

10. The portable cooler with fold out bar according to claim 9 wherein the ice well is an insulated container for storing ice;

wherein the ice well is coupled to the inside of the back shell;

wherein the ice is accessible via an ice door on the front of the ice well.

11. The portable cooler with fold out bar according to claim 10 wherein the multi-use bucket is an open-top container that is coupled to the inside of the back shell;

wherein the multi-use bucket is operable to hold items that are placed within the multi-use bucket.

12. The portable cooler with fold out bar according to claim 11 wherein the speed rail is an open top tray for holding liquors, wines, and mixers for immediate access.

13. The portable cooler with fold out bar according to claim 12 wherein the one or more bar accessories comprise one or more storage containers, one or more pockets, one or more bottle holders, one or more utensil holders, one or more towel holders, or combinations thereof;

wherein the one or more bar accessories hold the food, the beverages, and/or serving utensils that are needed at the venue.

14. The portable cooler with fold out bar according to claim 13 wherein the one or more storage containers are one or more containers coupled to the inside of the right door shell or the left door shell;

wherein the one or more storage containers close to contain the items within and are opened to add or remove items.

15. The portable cooler with fold out bar according to claim 13 wherein the one or more pockets are one or more pouches that are coupled to the inside of the right door shell or the left door shell.

16. The portable cooler with fold out bar according to claim 13 wherein the one or more bottle holders are cylindrical, open-topped receptacles that are closed on the bottom;

wherein the one or more bottle holders are each operable to hold a bottle;

wherein the one or more bottle holders are coupled to the inside of the left door shell or the right door shell.

17. The portable cooler with fold out bar according to claim 13 wherein the one or more utensil holders are cylindrical, open-topped receptacles that are closed on the bottom;

wherein the one or more utensil holders are each operable to hold one or more eating utensils;

wherein the one or more utensil holders are coupled to the inside of the left door shell or the right door shell.

18. The portable cooler with fold out bar according to claim 13 wherein the one or more towel holders are one or more hooks that are each operable to hold a towel;

wherein the one or more towel holders are coupled to the inside of the left door shell or the right door shell.

* * * * *